US008770933B2

(12) United States Patent
Chen et al.

(10) Patent No.: US 8,770,933 B2
(45) Date of Patent: Jul. 8, 2014

(54) TURBINE NOZZLE ASSEMBLIES AND METHODS FOR REPAIRING TURBINE NOZZLE ASSEMBLIES

(75) Inventors: Robert P. Chen, Torrance, CA (US); Dave Elpern, Los Angeles, CA (US); Stephen Vaccarezza, Torrance, CA (US); Alvin Powell, Anniston, AL (US)

(73) Assignee: Honeywell International Inc., Morristown, NJ (US)

( * ) Notice: Subject to any disclaimer, the term of this patent is extended or adjusted under 35 U.S.C. 154(b) by 489 days.

(21) Appl. No.: 13/149,530

(22) Filed: May 31, 2011

(65) Prior Publication Data

US 2012/0063894 A1 Mar. 15, 2012

Related U.S. Application Data

(60) Provisional application No. 61/381,777, filed on Sep. 10, 2010.

(51) Int. Cl.
*F01D 25/28* (2006.01)

(52) U.S. Cl.
CPC ..... *F01D 25/285* (2013.01); *F05D 2230/232* (2013.01); *F05D 2230/60* (2013.01); *F05D 2230/80* (2013.01)
USPC ..... 415/215.1; 415/213.1; 415/214.1; 29/889.1; 29/402.13; 29/402.16

(58) Field of Classification Search
USPC ..... 415/213.1, 214.1, 215.1; 29/889.1, 29/889.22, 402.11, 402.13, 402.16, 402.18
See application file for complete search history.

(56) References Cited

U.S. PATENT DOCUMENTS

| | | | | |
|---|---|---|---|---|
| 3,651,558 | A | 3/1972 | Chase | |
| 3,986,243 | A | 10/1976 | Schussler et al. | |
| 4,058,952 | A | 11/1977 | Donnelly | |
| 4,413,477 | A | 11/1983 | Dean et al. | |
| 5,111,570 | A | 5/1992 | Baumgarten et al. | |
| 6,024,418 | A | 2/2000 | Ebert | |
| 6,609,894 | B2 * | 8/2003 | Jackson et al. | 416/224 |
| 6,615,470 | B2 | 9/2003 | Corderman et al. | |
| 6,986,201 | B2 | 1/2006 | Moertle et al. | |
| 7,222,422 | B2 * | 5/2007 | Gupta et al. | 29/889.1 |
| 7,322,396 | B2 | 1/2008 | Govern et al. | |
| 7,802,350 | B2 | 9/2010 | Walker | |
| 2006/0042269 | A1 | 3/2006 | Markarian et al. | |
| 2007/0039175 | A1 * | 2/2007 | Rucker et al. | 29/889.1 |
| 2008/0213092 | A1 * | 9/2008 | Guo et al. | 415/210.1 |
| 2009/0064479 | A1 | 3/2009 | Anderson et al. | |
| 2009/0064500 | A1 * | 3/2009 | Reynolds et al. | 29/889.1 |
| 2009/0115141 | A1 | 5/2009 | Simmons | |
| 2010/0107639 | A1 | 5/2010 | Myers et al. | |
| 2012/0027617 | A1 * | 2/2012 | Garza et al. | 416/241 R |

* cited by examiner

*Primary Examiner* — Ned Landrum
*Assistant Examiner* — Justin Seabe
(74) *Attorney, Agent, or Firm* — Ingrassia Fisher & Lorenz, P.C.

(57) ABSTRACT

A method is provided for repairing a turbine nozzle assembly with an insert and a support structure. The method includes positioning the insert on the support structure of the turbine nozzle assembly; and plug welding the insert to the support structure of the turbine nozzle assembly.

12 Claims, 5 Drawing Sheets

TURBINE NOZZLE ASSEMBLIES AND METHODS FOR REPAIRING TURBINE NOZZLE ASSEMBLIES

PRIORITY CLAIMS

This application claims the benefit of U.S. Provisional Application No. 61/381,777, filed Sep. 10, 2010, the entirety of which is hereby incorporated by reference.

TECHNICAL FIELD

The present invention generally relates to turbine nozzle assemblies for air cycle machines or other type of turbine systems, and more particularly relates to methods for repairing such assemblies.

BACKGROUND

Engines with turbine systems, such as air cycle machines, use turbine blades to extract work from heated gases passing therethrough. The efficiency of the turbine system is directly dependent on the flow path of the heated gases. Particularly, a turbine nozzle assembly includes a shroud that surrounds the turbine blades to form the flow path. The turbine nozzle assembly further includes a support structure that secures the turbine nozzle assembly to other portions of the system, such as a bearing housing for the output shaft or a compressor. In addition to performance and efficiency requirements, the turbine nozzle assembly may be subject to safety requirements, such as containment testing or certification. In one such requirement, the turbine nozzle assembly may be required to withstand an axial load of more than 40,000 pounds. Maintenance and other repair work on the turbine nozzle assembly may complicate the ability to comply with the containment requirements, particularly if the repair work reduces containment capacity.

Accordingly, it is desirable to provide turbine nozzle assemblies that comply with applicable containment requirements. In addition, it is desirable to provide a method for a repairing a turbine nozzle assembly that maintains applicable containment requirements. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a method is provided for repairing a turbine nozzle assembly with an insert and a support structure. The method includes positioning the insert on the support structure of the turbine nozzle assembly; and plug welding the insert to the support structure of the turbine nozzle assembly.

In accordance with another exemplary embodiment, a turbine nozzle assembly is provided for a system. The assembly includes a shroud configured to surround a plurality of turbine blades; and a support structure comprising a support structure body coupled to the shroud and an insert configured to mount the turbine nozzle assembly to another portion of the system, the insert being secured to the support structure body with a plurality of plug welds.

In accordance with another exemplary embodiment, an air cycle machine, includes a compressor configured to receive and compress an air flow; a turbine system configured to receive the air flow and to extract energy with a plurality of turbine blades; a shaft coupled to the turbine blades and configured to transmit the extracted energy; a housing configured to house the shaft; and a turbine nozzle assembly coupling the turbine system to the housing. The turbine nozzle assembly includes a shroud configured to surround the plurality of turbine blades and to at least partially form a flow path for the air flow through the turbine system, and a support structure comprising a support structure body coupled to the shroud and an insert for coupling the turbine system to the housing, the insert being secured to the support structure body with a plurality of plug welds.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments discussed herein provide a turbine nozzle assembly for a turbine system that includes a support structure and a shroud surrounding the turbine blades. The nozzle assembly further includes an insert that couples the support structure to another portion of the system. The insert may be part of a repair process and be coupled to the support structure with plug welds. The plug welds enable the insert and support structure to function as an integral assembly such that the support structure and shroud do not separate from the insert during a containment event.

Figure 1:
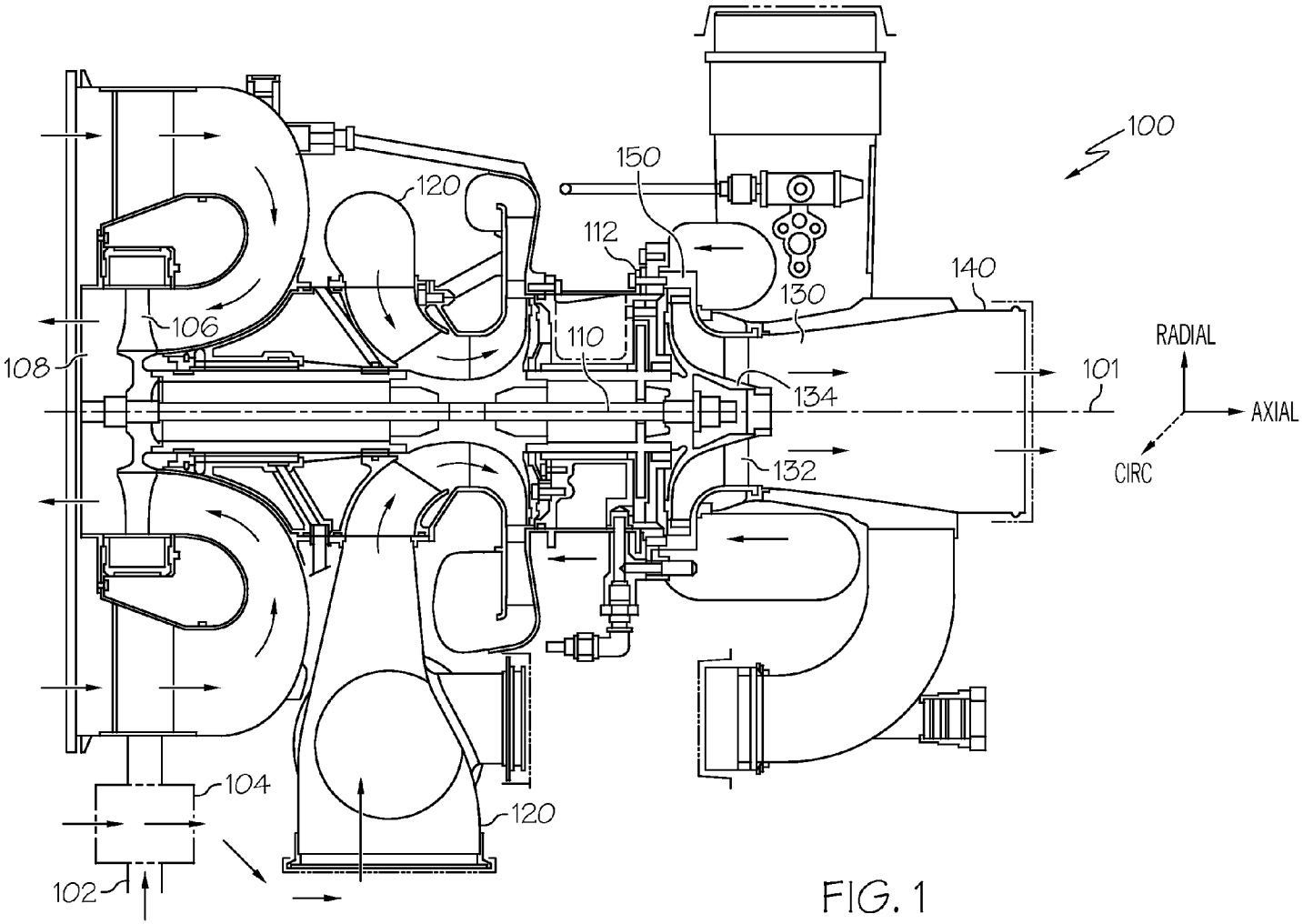
FIG. 1 shows a partial, schematic cross-sectional view of an air cycle machine having a turbine nozzle assembly according to an exemplary embodiment.

FIG. 1 shows a partial, schematic cross-sectional view of an air cycle machine 100. The air cycle machine 100, in the depicted embodiment, is annular about a central longitudinal axis 101. As used herein, FIG. 1 is a view of the air cycle machine 100 in the axial-radial plane with the circumferential direction being perpendicular to this plane. The air cycle machine 100 may form part of an environmental control system for an aircraft that generally provides conditioned air for a cabin (not shown). In other embodiments, the exemplary embodiments discussed herein may form part of any suitable application.

During operation, the air cycle machine 100 receives cold ambient air through a ram air inlet 102, which as shown, travels through a heat exchanger 104 that cools hot bleed air from the main engines (not shown). A fan 106 pulls the warmed air from the heat exchanger 104 through a duct 108 to be dumped overboard.

The cooled bleed air from the heat exchanger 104 is directed into a compressor 120 that compresses the cooled bleed air to a higher pressure and temperature. The air is subsequently directed to the turbine 130 where the air expands to drive turbine blades 132 mounted on a turbine hub 134. Air exits the turbine 130 and is directed to the cabin (not shown) via duct 140. The rotating turbine blades 132 power the fan 106 via a shaft 110. As shown in the depicted embodiment, the shaft 110 may be circumscribed by a housing, and particularly a bearing housing 112 on an aft end.

A nozzle assembly 150 forms part of the turbine 130. Particularly, the nozzle assembly 150 circumscribes the turbine blades 132 to form part of the flow path within the turbine 130. Additionally, as will be discussed in greater detail below, the turbine nozzle assembly 150 functions to couple the turbine 130 to the other portions of the machine 100. In one exemplary embodiment, the turbine nozzle assembly 150 is coupled at a forward or front interface to the bearing housing 112, at a circumferential interface to the compressor 120, and at a downstream interface to duct 140.

In one exemplary embodiment, the nozzle assembly 150 is required to satisfy safety containment tests. As such, the nozzle assembly 150 may be designed to maintain integrity if the turbine blades 132 detach from the turbine hub 134. In one exemplary embodiment, the turbine assembly (e.g., the turbine blades 132 and hub 134) may operate at speeds of 50,000 rpms or higher, depending on the machine 100 and testing requirements. In such situations, the turbine nozzle assembly 150 may be required to contain a detached turbine blade or hub portion at axial loads of over 40,000 pounds or greater, as one example.

Additionally, at times, the nozzle assembly 150 may be subject to deterioration or other issues at the interface between the bearing housing 112 and the nozzle assembly 150. In such situations, the nozzle assembly 150 may be repaired, and the repaired nozzle 150 should similarly satisfy the same standards as the original nozzle assembly 150. Exemplary embodiments for repairing the nozzle assembly 150 are discussed in greater detail below.

Figure 2:
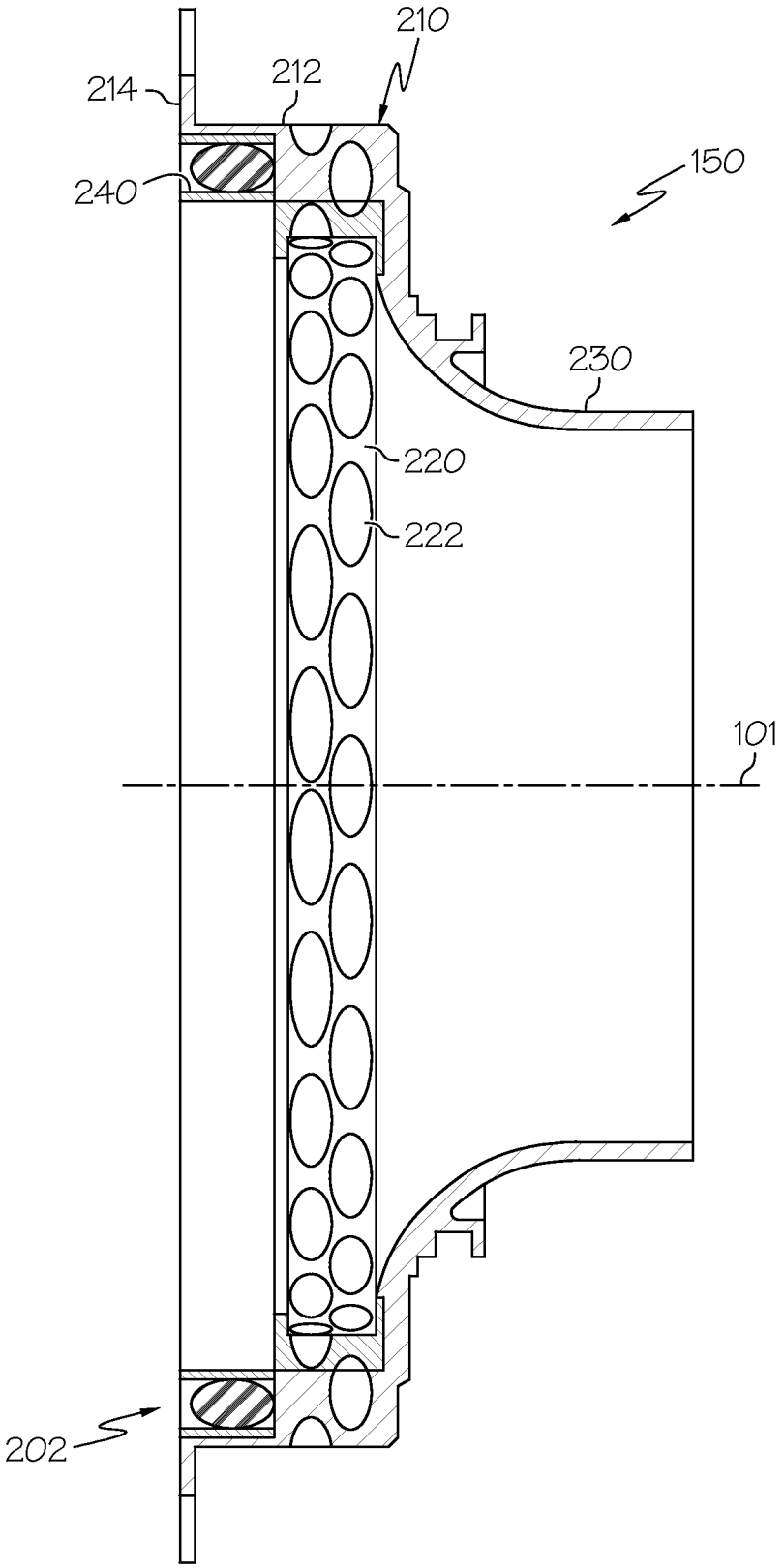
FIG. 2 is a cross-sectional view of the turbine nozzle assembly of FIG. 1 removed from the air cycle machine according to an exemplary embodiment.

FIG. 2 is a cross-sectional view of the nozzle assembly 150 removed from the air cycle machine 100 (FIG. 1). Other components may be omitted for clarity. As shown, the nozzle assembly 150 has a support structure 210, an inlet 220, and a shroud 230. In general, the support structure 210, inlet 220, and shroud 230 are ring shaped about the central axis 101. As introduced above and described in greater detail below, the support structure 210 generally mounts the nozzle assembly 150 to the bearing housing 112 (FIG. 1) at a forward interface 202. The inlet 220 is in an aft position relative to the support structure 210 and includes a number of inlet passages 222 extending circumferentially about the nozzle assembly 150 that receive air from the compressor 120 (FIG. 1). The inlet 220 transitions to the shroud 230, which surrounds the turbine blades 132 (FIG. 1) and forms a portion of the flow path for directing air downstream to duct 140 (FIG. 1).

The support structure 210 is formed by a support structure body 212 in the form of a circumferential ring, the front face of which forms part of the forward interface 202 for coupling to the bearing housing 112, as described below. The support structure 210 may further include a radial flange 214 that is configured to be coupled to the compressor 120 (FIG. 1). The support structure 210 further includes an insert 240, as designed or subsequently installed as part of a repair, as will be discussed in greater detail below.

The nozzle assembly 150 may be initially formed as an integral piece formed from a single material, although other implementations may be provided. However, at times, the nozzle assembly 150 may undergo repair, particularly to address deterioration at the forward interface 202 of the support structure 210. In such a situation, a portion of the support structure 210, particularly a portion of the support structure body 212, may be removed and replaced with the insert 240. In other embodiments, the support structure 210 may be initially manufactured with the insert 240 instead of being installed in a repair. In any event, as shown in the depicted embodiment, the insert 240 is a circumferential ring about the interior of the support structure 210. Further details about securing the insert 240 to the support structure 210 are discussed below.

Figure 3:
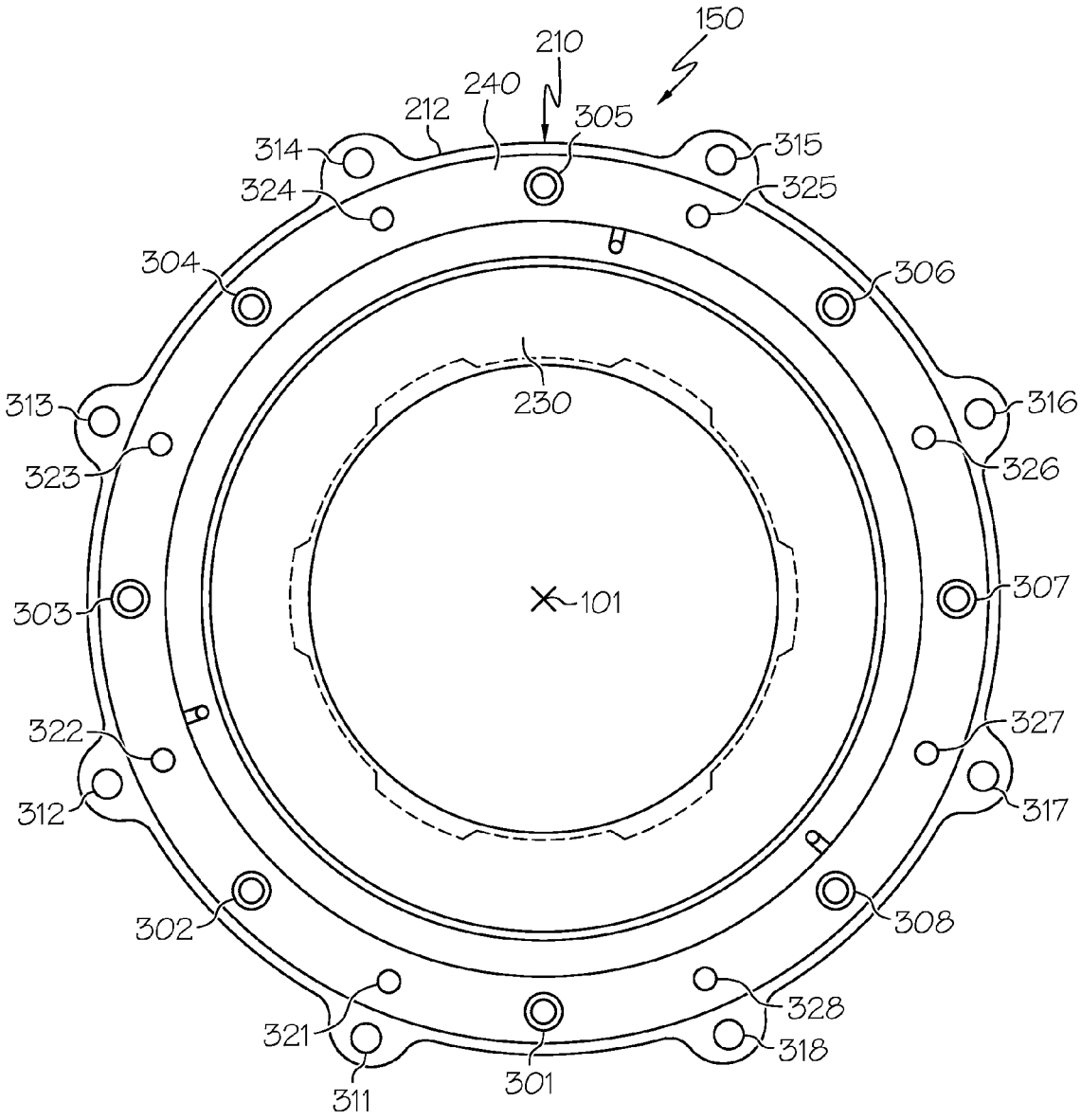
FIG. 3 is a front view of the turbine nozzle assembly of FIG. 2 in accordance with an exemplary embodiment.

FIG. 3 is a front view of the nozzle assembly 150 of FIG. 2 in accordance with an exemplary embodiment. As noted above, the nozzle assembly 150 is configured to be secured to the bearing housing 112 and the compressor 120 (FIG. 1). In particular, the support structure 210 includes number of first mounting holes 301-308 extending in an axial direction into the insert 240. The mounting holes 301-308 enable the insert 240, and thus the nozzle assembly 150, to be coupled to the bearing housing 112 with bolts or other fastening mechanisms. As also shown in FIG. 3, the support structure 210 further includes a number of second mounting holes 311-318 extending in an axial direction into the radial flange 214 such that the support structure 210, and thus the nozzle assembly 150, may be coupled to compressor 170 with bolts or other fastening mechanisms.

As also shown in FIG. 3, the support structure 210 includes a number of plug welds 321-328 that secure the insert 240 to the support structure 210, particularly to the underlying support structure body 212. As is generally known, a plug weld is a circular weld fused in a hole of a first component to form a joint with a second component positioned directly beneath the first component. In this embodiment, the plug welds 321-328 are formed to join the insert 240 to the underlying support structure 210. Any number of plug welds 321-328 may be provided. As particularly shown in the exemplary embodiment of FIG. 3, eight plug welds 321-328 are provided and positioned circumferentially in between the first mounting holes 301-308 in the insert 240. For example, the positions of the plug welds 321-328 may be circumferentially aligned and radially clocked relative to the first mounting holes 301-308. In one exemplary embodiment, each plug weld 321-328 may be positioned equidistant between adjacent mounting holes 301-308. In the depicted embodiment, the plug welds 321-328 may be radially aligned with the second mounting holes 311-318. In other embodiments, the plug welds 321-328 may be provided in any pattern to secure the insert 240, including asymmetrical patterns or unequal spacings.

Figure 4:
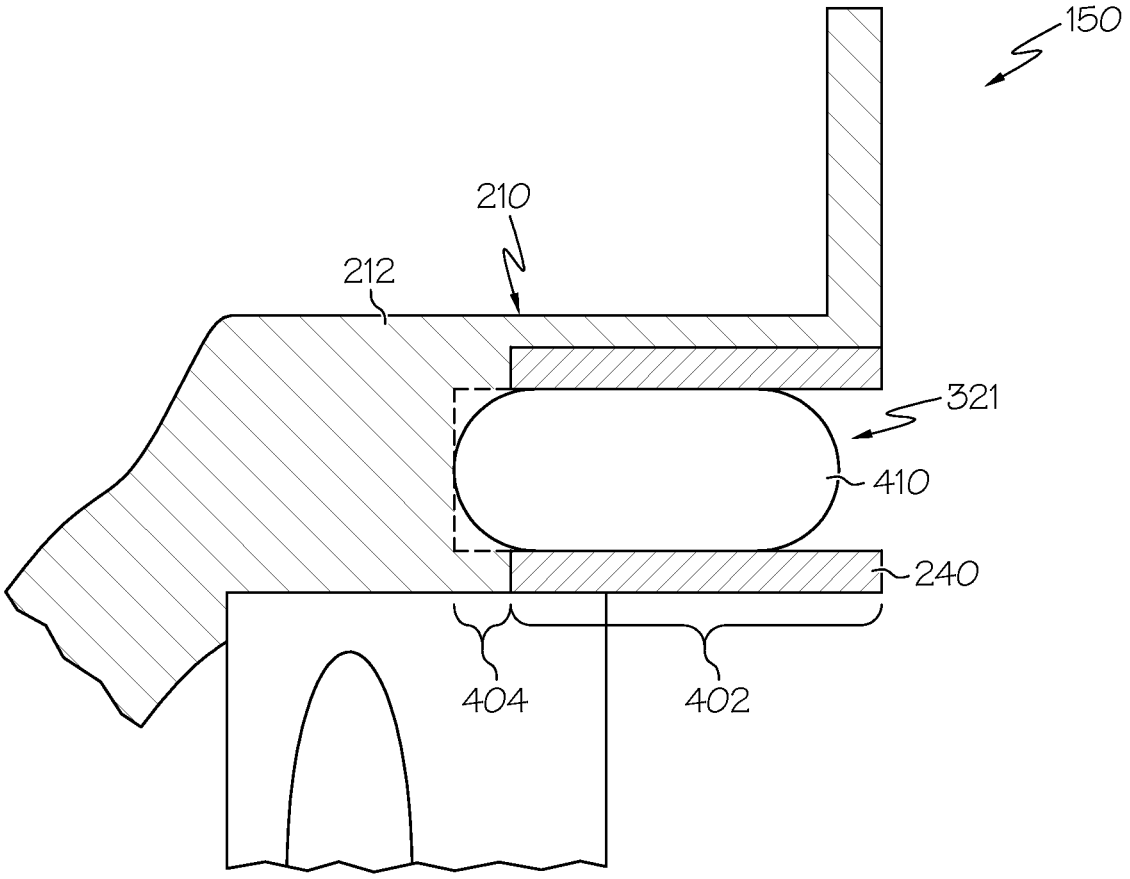
FIG. 4 is a partial, more detailed cross-sectional view of the turbine nozzle assembly of FIGS. 1 and 2 in accordance with an exemplary embodiment.

The plug welds 321-328 are additionally discussed with reference to FIG. 4, which is a more detailed cross-sectional view of a representative plug weld such as plug weld 321. As shown in FIG. 4, the plug weld 321 generally includes a first hole 402 formed in the insert 240 and a second hole 404 formed in the underlying support structure body 212. The first hole 402 in the insert 240 is a through-hole, while the second hole 404 may be shallow and extend only a small distance into the support structure body 212. In one exemplary embodiment, the depth of the second hole 404 may vary, although the surface of the support structure body 212 is generally penetrated to at least some depth. In one exemplary embodiment, the second hole 404 may be a milled-flat bottom hole of approximately 0.500 inches, although the dimensions may vary as discussed below. The holes 402 and 404 are then filled with molten weld rod material 410 that, when solidified, secures the insert 240 to the support structure body 212.

Although the dimension may vary, in a nozzle assembly 150 that has a diameter of about 6.9 inches at the outer circumference of the support structure body 212, the holes 402 and 404 for the plug weld 321 may be, for example, about 0.25 inches. Generally, the plug weld rod material 410 fills the holes 402 and 404, although in one exemplary embodiment in which the holes 402 and 404 collectively have a depth of about 0.47-0.5 inches, the plug weld 321 may have a height of about 0.3 inches. In one exemplary embodiment, the support structure 210 and insert 240 may be stainless steel, such as 17-4PH stainless steel. The weld rod material 410 may be any material that complies with the applicable standard or equivalent, such as MIL-STD-2219 or MIL-E-23765, each of which may be incorporated by reference.

Accordingly, the plug welds 321-328 secure the insert 240 to the support structure body 212. In this manner, the nozzle assembly 150 may be coupled to the bearing housing 112 (FIG. 1) at the insert 240 and perform as an integral nozzle assembly 150. As such, during a containment test or event, the insert 240 will not prematurely separate from the rest of the support structure 210 and nozzle assembly 150, thereby preventing undesired behavior of the nozzle assembly 150. The plug welds 321-328 additionally enable more narrow wall thicknesses in the support structure 210 than would otherwise be available with other mounting techniques.

Figure 5:
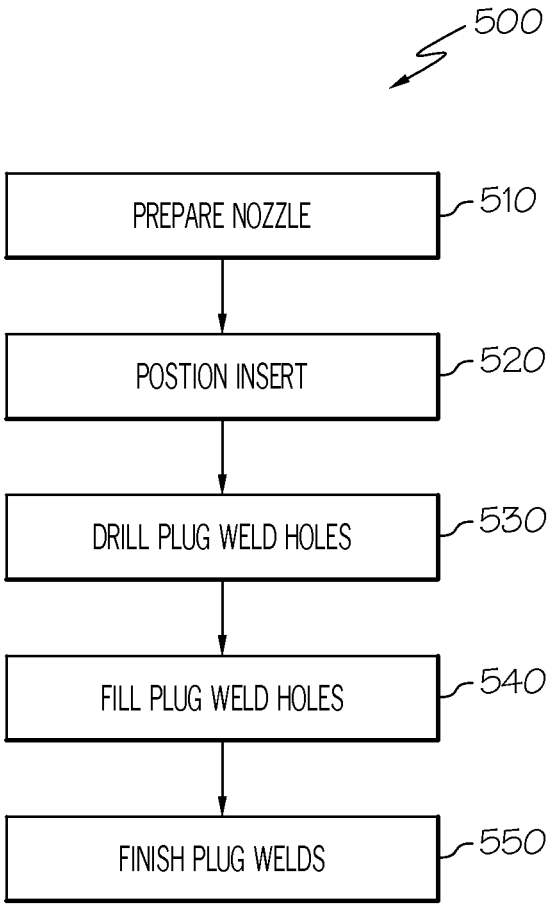
FIG. 5 is a flow chart of a method for repairing a turbine nozzle assembly in accordance with an exemplary embodiment.

Further details about the plug welds 321-328 are provided in FIG. 5, which is a flow chart of a method 500 for repairing a turbine nozzle assembly in accordance with an exemplary embodiment. The method 500 may be used to repair the nozzle assembly 150 discussed above, and as such, FIGS. 1-4 will be referenced below.

In a first step 510, the support structure 210 is prepared for the insert 240. For example, in one exemplary embodiment, any deterioration in the support structure body 212 is removed. The support structure body 212 may be prepared by removing contamination and burrs that may weaken the subsequent weld. Typically, a portion of the support structure body 212 corresponding to the dimensions of the insert 240 may be machined away or otherwise removed. In the alternative, the insert 240 may be designed to correspond to the removed portions of the support structure body 212.

In a second step 520, the insert 240 is positioned on the support structure 210. In an alternate exemplary embodiment, the support structure 210 may be initially designed with the insert 240, and the repair method 500 may be used to install or replace an insert. In such an embodiment, the first step 510 may be omitted.

In a third step 530, a number of plug weld holes 402 and 404 are drilled in the insert 240. The plug weld holes 402 and 404 are generally axial holes that extend through the insert 240 and into the underlying support structure body 212. Any number of plug weld holes 402 and 404 may be provided, although in one exemplary embodiment, eight plug weld holes 404 and 404 are drilled circumferentially in between the mounting holes 301-308 formed in the insert 240.

In a fourth step 540, the plug weld holes 402 and 404 are filled with weld rod material 410. In one exemplary embodiment, the following welding techniques may be implemented: clean and prepare the holes 402 and 404; apply a heat fence; clamp the insert 240 to the support structure body 220 or the shroud 230; weld fill the holes at 180° intervals optionally leaving weld material slightly puddle about the surface; and remove heat fence.

In a fifth step 550, the plug welds 321-328 are finished by removing any excess plug weld rod material 410 by machining the plug weld 321-328 to blend the plug weld 321-328 with the surface of the insert 240. The plug welds 321-328 may also be tested for integrity, for example, with a fluorescent penetrant and pull test of a sample. Jigs and other fixtures may be used to hold the support structure body 212 and the insert 240 in proper alignment during one or more of steps 510, 520, 530, 540, and 550.

Accordingly, exemplary embodiments may provide an improved turbine nozzle assembly repaired or designed with an insert that enables the assembly to function as an integral assembly. Particularly, the assemblies may perform as desired without significant rework or expensive manufacturing processes, thereby improving durability and safety while reducing downtime. The turbine nozzle assemblies are discussed above with reference to an air cycle machine, although it should be noted that the turbine nozzle assemblies may be incorporated into any type of application. For example, auxiliary power units, starter turbomachines, gas turbine engines, generators, and the like can employ one or more embodiments of the assemblies described above. Thus, although an air cycle engine is used for context, embodiments can be present in any device which includes an assembly forming a compressor or turbine shroud coupled to a support structure.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for repairing a turbine nozzle assembly with an insert and a support structure, wherein the turbine nozzle assembly is annular with a central axis, comprising the steps of:

positioning the insert on the support structure of the turbine nozzle assembly, wherein the insert includes first mounting holes circumferentially arranged around the insert and configured to mount the nozzle assembly; and plug welding the insert to the support structure of the turbine nozzle assembly, wherein the plug welding step includes drilling a hole through the insert and into a surface of the support structure in an axial direction relative to the turbine nozzle assembly; and filling the hole with a weld material, wherein the plug welding step includes plug welding the insert to the support structure at a plurality of plug weld positions, and wherein the plug welding step includes plug welding such that the plug weld positions are circumferentially aligned and radially clocked relative to the first mounting holes.

2. The method of claim 1, wherein the plug welding step includes positioning each of the plug weld positions equidistant between the first mounting holes.

3. The method of claim 1, wherein the plug welding step includes equally spacing the plug weld positions around the insert.

4. The method of claim 1, further comprising the step of removing any deterioration in the support structure prior to the positioning step.

5. A turbine nozzle assembly for a system, comprising a shroud configured to surround a plurality of turbine blades; and a support structure comprising a support structure body coupled to the shroud and an insert configured to mount the turbine nozzle assembly to another portion of the system, the insert being secured to the support structure body with a plurality of plug welds, wherein the plug welds extend through the insert and into the support structure body, wherein the support structure is annular with a central axis and the plug welds extend in an axial direction relative to the support structure, and wherein the insert includes a plurality of first mounting holes for mounting the turbine nozzle assembly to the another portion of the system, the plug welds being circumferentially aligned and radially clocked relative to the first mounting holes.

6. The turbine nozzle assembly of claim 5, wherein each of the plug welds is positioned equidistant between adjacent first mounting holes.

7. The turbine nozzle assembly of claim 5, wherein the plug welds are equally spaced around the insert.

8. An air cycle machine, comprising:

a compressor configured to receive and compress an air flow;

a turbine system configured to receive the air flow and to extract energy with a plurality of turbine blades;

a shaft coupled to the turbine blades and configured to transmit the extracted energy;

a housing configured to house the shaft; and a turbine nozzle assembly coupling the turbine system to the housing and comprising a shroud configured to surround the plurality of turbine blades and to at least partially form a flow path for the air flow through the turbine system, and a support structure comprising a support structure body coupled to the shroud and an insert for coupling the turbine system to the housing, the insert being secured to the support structure body with a plurality of plug welds, wherein the insert includes a plurality of first mounting holes for mounting the turbine nozzle assembly to the housing, the plug welds being circumferentially aligned and radially clocked relative to the first mounting holes.

9. The air cycle machine of claim 8, wherein the turbine nozzle assembly further comprises an inlet coupled the support structure for receiving the air flow from the compressor.

10. The air cycle machine of claim 8, wherein the plug welds extend through the insert and into the support structure body.

11. The air cycle machine of claim 8, wherein the support structure is annular with a central axis and the plug welds extend in an axial direction relative to the support structure.

12. The air cycle machine of claim 8, wherein each of the plug welds is positioned equidistant between adjacent first mounting holes.

* * * * *